US010411427B2

(12) United States Patent
Hall et al.

(10) Patent No.: US 10,411,427 B2
(45) **Date of Patent: *Sep. 10, 2019**

(54) ELECTRICALLY CONDUCTIVE WALL CONNECTOR

(71) Applicant: Hall Labs LLC, Provo, UT (US)

(72) Inventors: David R. Hall, Provo, UT (US); Andrew Priddis, Mapleton, UT (US); Braquel Burnett, Provo, UT (US); Jonathan Conley, Provo, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/101,313

(22) Filed: Aug. 10, 2018

(65) Prior Publication Data

US 2018/0351313 A1 Dec. 6, 2018

Related U.S. Application Data

(63) Continuation of application No. 15/467,193, filed on Mar. 23, 2017, now Pat. No. 10,084,275.

(51) Int. Cl.
*H01R 33/02* (2006.01)
*H01R 33/92* (2006.01)
*H01R 25/16* (2006.01)

(52) U.S. Cl.
CPC ..... *H01R 33/02* (2013.01); *H01R 25/162* (2013.01); *H01R 33/92* (2013.01)

(58) Field of Classification Search
CPC ..... H01R 33/02; H01R 33/92; H01R 13/60
USPC ..... 439/540.1, 32, 110
See application file for complete search history.

(56) References Cited

U.S. PATENT DOCUMENTS 5,128,847 A * 7/1992 Lin ..... F21V 23/02 362/147
7,434,951 B2 * 10/2008 Bienick ..... A47B 97/00 362/133
7,731,524 B2 * 6/2010 Dittus ..... H05K 7/1492 361/727
8,662,695 B2 * 3/2014 Wilson ..... F21S 8/04 362/147
2005/0082862 A1 * 4/2005 Anderson ..... B60R 7/04 296/37.7
2011/0290303 A1 * 12/2011 Weldon ..... H01R 13/6315 136/251
2017/0070016 A1 * 3/2017 Destro ..... H01R 9/26

* cited by examiner

*Primary Examiner* — Abdullah A Riyami
*Assistant Examiner* — Nader J Alhawamdeh

(57) ABSTRACT

The invention is a system for simultaneously, yet safely, suspending and powering objects through connectors on a wall. The system includes one or more connectors, preferably pins, mounted to a wall. Each connector has a groove and a lip that houses an electrical conductor, which may be a metal rod. One or more suspendable objects, which may be storage bins or electrical appliances, are designed to engage with the connectors. Each suspendable object has at least one horizontal track that guides the lip of each connector into one or more openings in the track. When the lip engages an opening, the object is suspended from the wall. Each opening also contains an electrical conductor that engages with the electrical conductor within the connector, thereby providing power to the suspendable object. The connectors may be attached to rails, and the system may be utilized within an automated storage and retrieval system.

20 Claims, 10 Drawing Sheets

ELECTRICALLY CONDUCTIVE WALL CONNECTOR

CROSS-REFERENCES

This application is a continuation of U.S. patent application Ser. No. 15/467,193, filed on Mar. 23, 2017, entitled "Electrically Conductive Wall Connector."

TECHNICAL FIELD

This invention relates generally to the field of connectors, and more specifically to electrically conductive wall connectors.

BACKGROUND

A typical household utilizes numerous appliances for functioning in everyday life, and many of these appliances require electricity to operate. Most electrical appliances come equipped with a power cord that is plugged into an outlet in order to receive the necessary power. Frequently, when an electrical appliance is not in use, the power cord is wrapped up (often in a rather haphazard fashion), and the appliance is put away into a storage area. However, this ordinary process has several disadvantages.

First, it is inconvenient to repeatedly remove an item from storage for use, to plug it in to an electrical outlet, and then to unplug and return it again. This is not to mention the difficulty of wrapping up and storing power cords, which are built rather inflexibly and often end up in only a tangled mess. Leaving all appliances out of storage and always available for use might be an option, but besides the lack of adequate space, there are often not enough outlets to accommodate powering multiple items simultaneously. Even when there are enough outlets, many power cords coming from multiple appliances can be a safety hazard and an eye-sore.

Therefore, it is desirable to have a quick and easy way to connect and disconnect an appliance to and from power without the use of a power cord. Furthermore, convenient storage and adequate space problems could be solved by a system that allowed a single mechanism to simultaneously supply electrical power and also support an electrical appliance, such as by suspending the appliance from a wall.

Some designs, such as powered rails, allow for simultaneous transfer of electrical power and structural support to appliances. However, these designs often leave the electrical conductors exposed, so that safety concerns may offset the advantages of speed and simplicity achieved through the lack of a power cord. Attempts to improve the safety of powered rails through the addition of insulative materials have complicated the connecting process. Using insulation often requires precise alignment of the electrical conductors of the powered rails with electrical conductors of the appliances, requiring more time and effort. Additionally, forming a connection between the two sets of conductors often requires greater force in order to move the electrical conductors of the appliance through the insulation to the electrical conductors of the powered rails. A similarly greater force is then required to disconnect the appliance from the powered rails. In such a case, a tradeoff is made sacrificing ease and simplicity for safety. Other connectors that provide both electrical power and structural support for appliances make similar tradeoffs.

Therefore, in light of the foregoing, what is needed is a mechanism that provides a quick and easy means for providing both electrical power and structural support to an appliance, but a means that is safe and that requires minimal physical force.

SUMMARY OF THE INVENTION

The disclosed invention has been developed in response to the present state of the art and, in particular, in response to the problems and needs in the art that have not yet been fully solved by currently available components and methods. Accordingly, efficient structural components and methods have been developed to allow for a mechanism that provides a safe, quick, and easy connection for providing structural support and electrical power to an appliance.

Consistent with the foregoing, a system is disclosed. The system comprises one or more connectors mounted to a wall. Each connector comprises a groove, which comprises a lip, which comprises a first electrical conductor. The first electrical conductor is coupled to a source of electrical power. The system also comprises one or more suspendable objects. Each suspendable object comprises at least one horizontal track, which comprises at least one opening. The at least one opening engages the lip of the one or more connectors when the one or more connectors slide along the at least one horizontal track. The one or more suspendable objects are thereby suspended from the wall. Furthermore, the at least one opening of each suspendable object comprises a second electrical conductor. The second electrical conductor engages the first electrical conductor when the at least one opening of each suspendable object engages the lip of the one or more connectors.

In some embodiments, the one or more connectors comprise specified shapes or sizes. The one or more suspendable objects may be storage bins or electrical appliances in certain embodiments. Some embodiments further comprise one or more rails mounted to the wall, the one or more connectors being attached to the one or more rails. One embodiment comprises two rails, one wired with a live wire, and one wired with a neutral wire. Finally, the one or more connectors and the one or more suspendable objects may be components in an automated storage and retrieval system.

BRIEF DESCRIPTION OF THE DRAWINGS

A more particular description of the invention briefly described above is made below by reference to specific embodiments depicted in drawings included with this application, in which.

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

Figure 1:
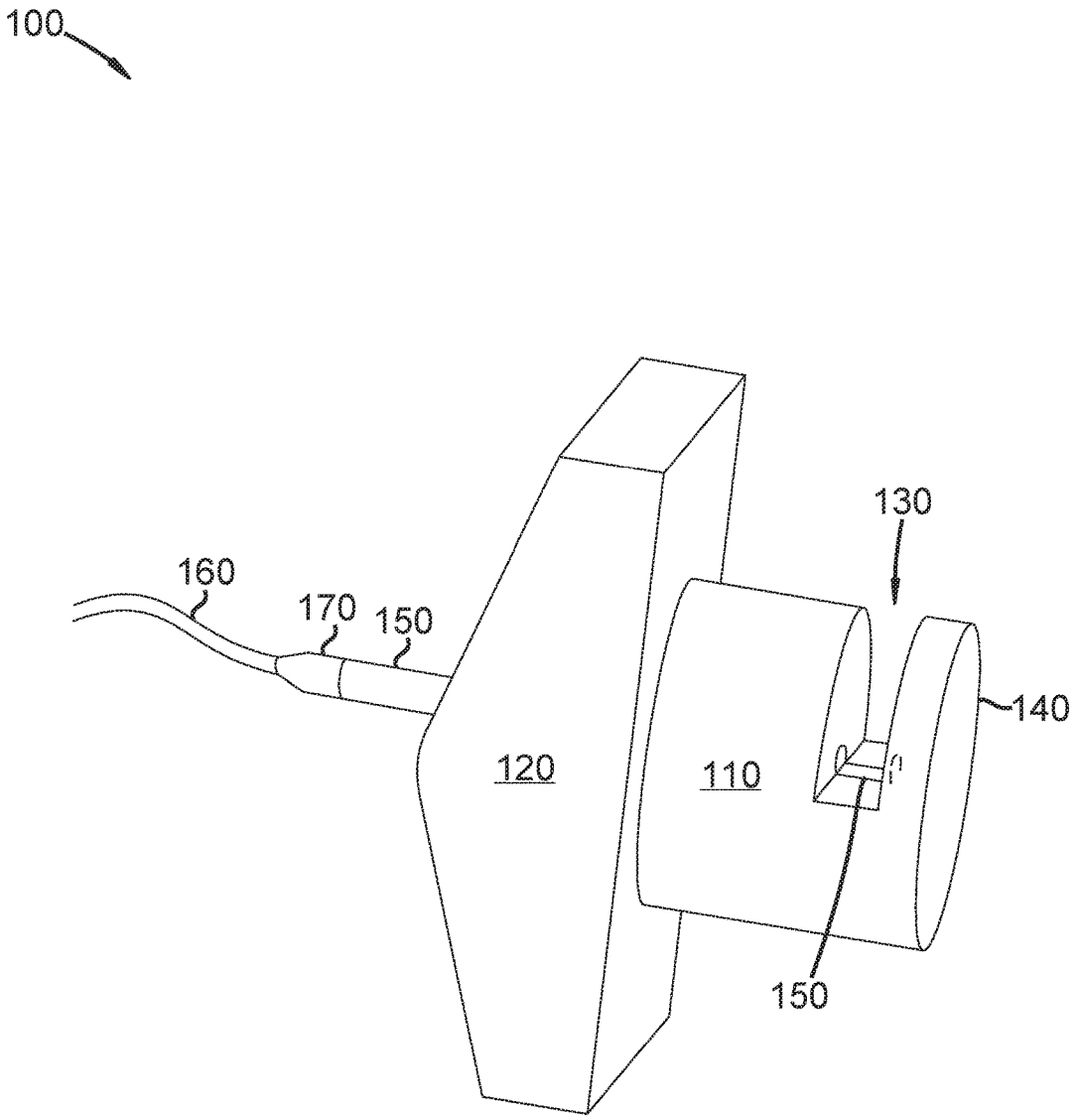
FIG. 1 depicts one embodiment of a connector.

The invention is a system that comprises one or more connectors 100 mounted to a wall. A connector is a member attached to a wall by means of which an object can be attached to or suspended from the wall. FIG. 1 depicts one embodiment of a connector 100. In one embodiment, the connector 100 comprises a cylindrical pin 110, which may protrude perpendicularly from the wall. In one embodiment, the cylindrical pin 110 has a diameter of between approximately 0.5 inches and 1 inch, preferably 0.75 inches. In one embodiment, the connector 100 may comprise a stopper member 120, which may have a substantially rectangular or pentagonal prismatic configuration. In one embodiment, the cylindrical pin 110 protrudes from the stopper member 120, and the stopper member 120 is larger than the cylindrical pin 110, extending at least a few millimeters beyond the edges of the cylindrical pin 110 in every direction. In other embodiments, the connector 100 may have different configurations. In one embodiment, each connector 100 is made from an insulative material, such as plastic or rubber. The material must be strong enough to support the weight of the one or more suspendable objects that may hang from each connector 100. In one embodiment, each connector 100 can hold up to 20 pounds of weight. Each connector 100 is mounted to a wall. In one embodiment, each connector 100 is mounted directly to the wall, and each connector 100 may be mounted using screws, bolts, nails, or other means commonly known in the art. In another embodiment, one or more rails are mounted to the wall, and the one or more connectors 100 are attached to the rails. In this embodiment, the stopper member 120 holds each connector 100 in place within the rails.

Each connector 100 comprises a groove 130, which comprises a lip 140, which comprises a first electrical conductor 150. In one embodiment, the groove 130 of each connector 100 comprises a right-angled slot cut into the connector 100, spanning a width of the connector 100 and approximately one half of a height of the connector 100, as depicted in FIG. 1. In one embodiment, the groove 130 of each connector 100 measures between approximately 0.1 and 0.2 inches in depth (from front to back), preferably measuring 0.15 inches in depth. The lip 140 is a segment of the connector 100 that extends out beyond the groove 130. In one embodiment, the lip 140 measures between approximately 0.05 inches and 1 inch in depth, preferably measuring approximately 0.1 inches in depth. The lip 140 must be sized and dimensioned in such a way that it fits securely inside openings formed in the one or more suspendable objects that are suspended from each connector 100, as described in more detail below. In one embodiment, the first electrical conductor 150 in each connector 100 comprises a metal rod. In one embodiment, the metal rod extends through the groove 130, but within the groove 130, the metal rod is milled down to a flat, right-angled indentation, such that an object can rest in a level position within the groove 130, and the first electrical conductor 150 extends up two sides of the groove 130, one side being the lip 140. In other embodiments, the first electrical conductor 150 may be one of a variety of other electrical conductors commonly known in the art.

The first electrical conductor 150 is coupled to a source of electrical power 160. In one embodiment, the source of electrical power 160 comprises wires, such as those located inside a wall that are coupled to an electrical circuit. In one embodiment, the first electrical conductor 150, which may be a metal rod, is coupled to the source of electrical power 160 by means of a fastener 170. In one embodiment, the source of electrical power 160 comprises wires that are located inside one or more rails that are mounted to the wall. In one embodiment, there are two rails, one wired with a live wire and one wired with a neutral wire. In one embodiment, the wires within the rails are coupled to wires located inside the wall that are coupled to an electrical circuit. In another embodiment, the wires within the rails are joined into a common electrical plug that can be plugged into an electrical outlet.

Figure 2:
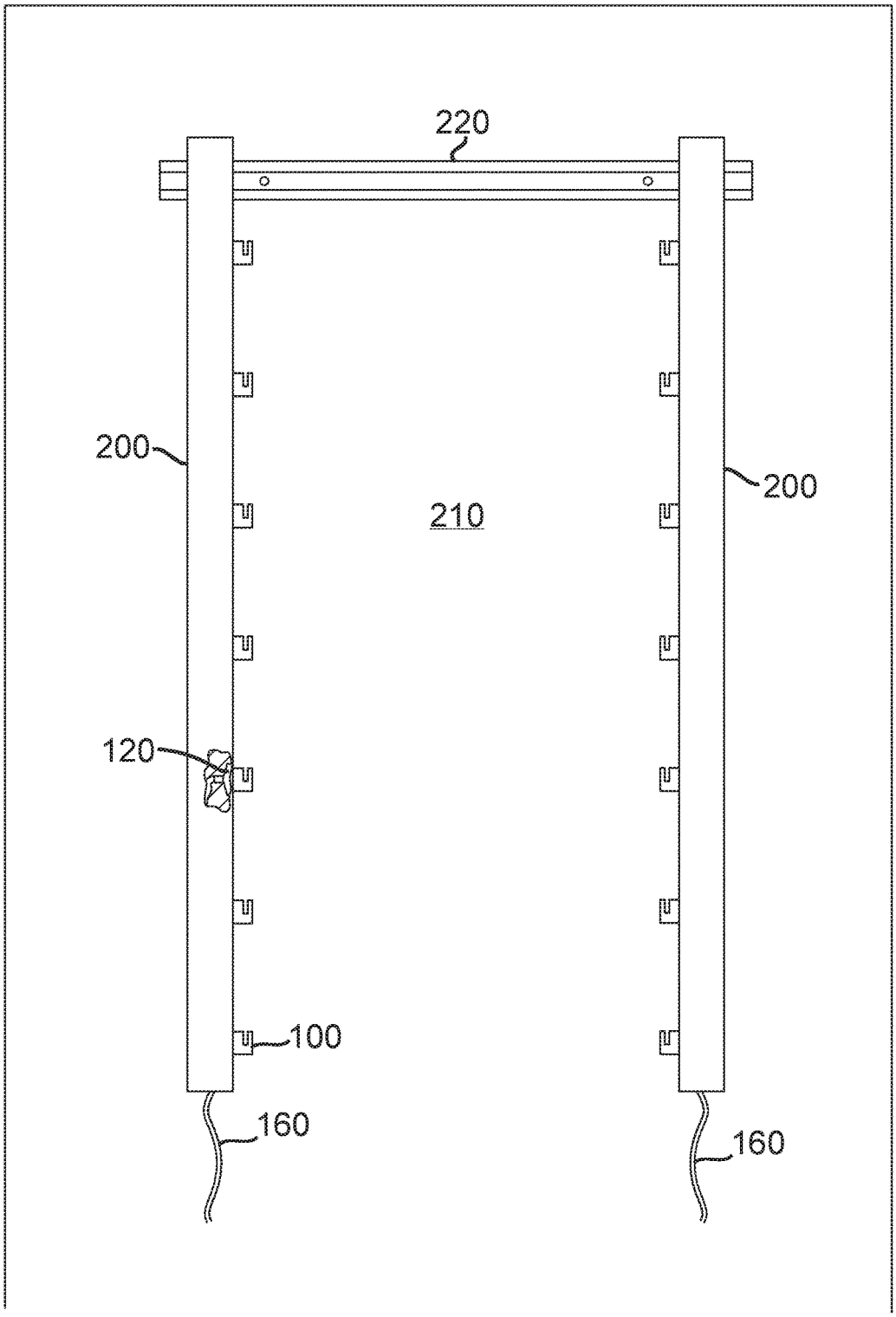
FIG. 2 depicts one embodiment of one or more rails mounted to a wall and one or more connectors attached to the one or more rails.

FIG. 2 depicts one embodiment of one or more rails 200 mounted to a wall 210 and one or more connectors 100 attached to the one or more rails 200. The invented system comprises one or more connectors 100 mounted to a wall 210, but in one embodiment, the invented system further comprises one or more rails 200 mounted to the wall 210, and the one or more connectors 100 attached to the one or more rails 200, thus being indirectly mounted to the wall 210. In one embodiment, there are two rails 200. Other embodiments comprise only one rail 200, or more than two rails 200. In one embodiment, each rail 200 extends vertically down the wall 210. In one embodiment, each rail 200 hangs from a horizontal crossbar 220. In one embodiment, each rail 200 is hollow. In one embodiment, one or more connectors 100 are attached to the one or more rails 200 by being inserted through holes in the one or more rails 200. Stopper members 120 on the one or more connectors 100 may hold the one or more connectors 100 in place within the holes in the one or more rails 200. In one embodiment, the one or more connectors 100 are attached to the one or more rails 200 in a position such that the one or more connectors 100 are parallel to the wall 210. In one embodiment, the one or more connectors 100 are attached to the one or more rails 200 in a position such that the one or more connectors 100 protrude perpendicularly from the wall 210. In one embodiment, each connector 100 is attached to the one or more rails 200 at a distance apart from the other connectors 100 that is equivalent to the size of a suspendable object to be suspended from the one or more connectors 100. In one embodiment, each connector attached to one rail 200 is spaced approximately 12.5 inches apart to allow for a suspendable object that is twelve inches tall. In one embodiment, each rail 200 is spaced at a distance apart from each other rail 200 that is equivalent to the size of a suspendable object to be suspended from the connectors 100 attached to the one or more rails 200. In one embodiment, each rail 200 is spaced approximately twenty inches apart. In one embodiment, a source of electrical power 160, preferably wires, runs through the one or more rails 200, connected to the one or more connectors 100, and supplying electrical power to the one or more connectors 100. In one embodiment, each rail 200 is wired with both live and neutral wires. In another embodiment, there are two rails 200, and one is wired with a live wire and one is wired with a neutral wire. The one or more connectors 100 attached to the two rails 200 thus have respective live and neutral wiring. When a suspendable object 300 is suspended simultaneously from one live connector 100 and one neutral connector 100, a complete circuit is formed, supplying power to the suspendable object. In one embodiment, the wires within the rails 200 are coupled directly to wires located within the wall 210 that are part of an electrical circuit. In another embodiment, the wires within the rails 200 are joined at the position where they protrude from the rails 200 into a common electrical plug that can be plugged into an electrical outlet.

Figure 3A:
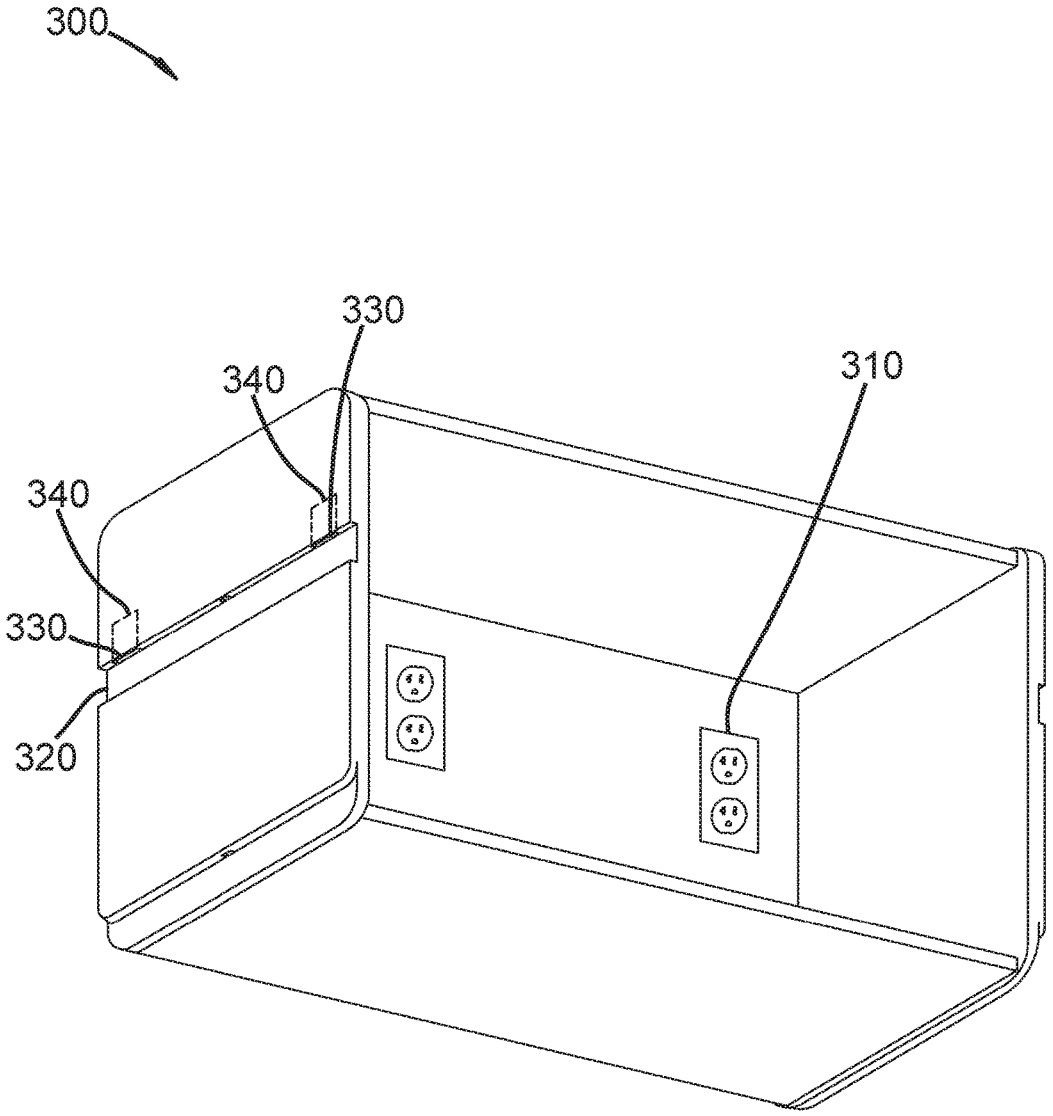
FIG. 3A depicts one embodiment of a suspendable object comprising a storage bin.
Figure 3B:
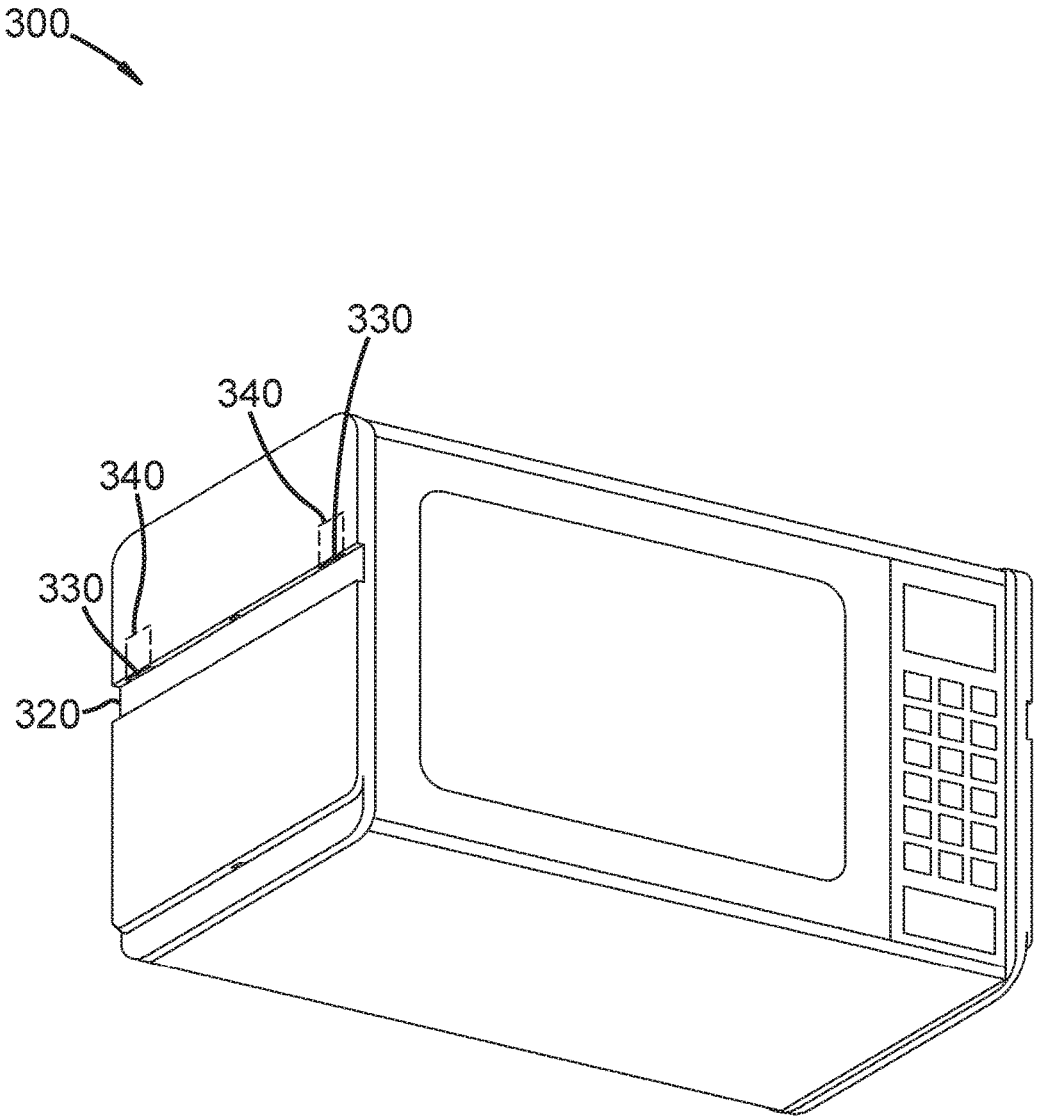
FIG. 3B depicts one embodiment of a suspendable object comprising an electrical appliance.

The invented system also comprises one or more suspendable objects 300. FIG. 3A and FIG. 3B depict embodiments of suspendable objects 300. In one embodiment, the one or more suspendable objects 300 comprise storage bins, as depicted in FIG. 3A. The storage bins may be rectangular in configuration, and they may be open at the top or at a side. The storage bins may comprise one or more electrical outlets 310. In another embodiment, the one or more suspendable objects 300 comprise electrical appliances, as depicted in FIG. 3B. The electrical appliances may be selected from a group consisting of microwaves, refrigerators, ice machines, heaters, toasters, mixers, ovens, juicers, dryers, grinders, dispensers, freezers, gas and electric cook tops, gas and electric ranges, bread machines, humidifiers, and grills. In other embodiments, the one or more suspendable objects 300 may comprise a variety of other objects in a variety of configurations that can be suspended from a wall. In one embodiment, the one or more suspendable objects 300 are dimensioned to fit within an automated storage and retrieval system. In one embodiment, the one or more suspendable objects 300 are approximately 12 inches tall, 12 inches deep, and 20 inches wide. In one embodiment, each suspendable object 300 can weigh up to approximately 20 pounds. In one embodiment, each suspendable object 300 comprises an insulative material, such as plastic. In other embodiments, each suspendable object comprises a different material, such as metal, preferably a lightweight metal, or wood. In one embodiment, each suspendable object 300 comprises one or more end effector connection points, such that each suspendable object 300 can interact with a robotic mechanism.

Each suspendable object 300 comprises at least one horizontal track 320 that comprises at least one opening 330. In one embodiment, each horizontal track 320 comprises an indentation in the suspendable object 300. In one embodiment, each horizontal track 320 spans a width of the suspendable object 300. In one embodiment, each horizontal track 320 is approximately 0.6 inches tall and 0.375 inches deep. In one embodiment, the at least one opening 330 is located at the top of each horizontal track 320. In one embodiment, each suspendable object 300 comprises two horizontal tracks 320, which may be located in identical positions on two opposite sides of the suspendable object 300. In one embodiment, each horizontal track 320 comprises two openings 330. In one embodiment, each opening 330 measures between approximately 0.01 and 0.5 inches in depth, preferably measuring approximately 0.2 inches in depth. In one embodiment, each opening 330 is small enough that it does not admit a human finger. This is necessary so that the electrical connection is completely insulated from human interaction and completely safe. Each opening 330 engages each lip 140 of the one or more connectors 100 when the one or more connectors 100 slide along the at least one horizontal track 320. Therefore, in one embodiment, each opening 330 is dimensioned such that the lip 140 of each connector 100 fits securely inside the opening 330. This is necessary so that the suspendable object 300 can be suspended from the wall by means of the connection between the lip 140 and the opening 330. Each opening 330 comprises a second electrical conductor 340. The second electrical conductor 340 engages the first electrical conductor 150 when the at least one opening 330 engages the lip 140, thereby supplying power to the suspendable object 300. In one embodiment, the second electrical conductor 340 comprises a metal blade. In other embodiments, the second electrical conductor 340 comprises another of a variety of electrical conductors commonly known in the art. The second electrical conductor 340 is connected to the wiring within the suspendable object 300 that is necessary to power the suspendable object 300 (or any appendages), which wiring may be located within the walls of the suspendable object 300.

Figure 4:
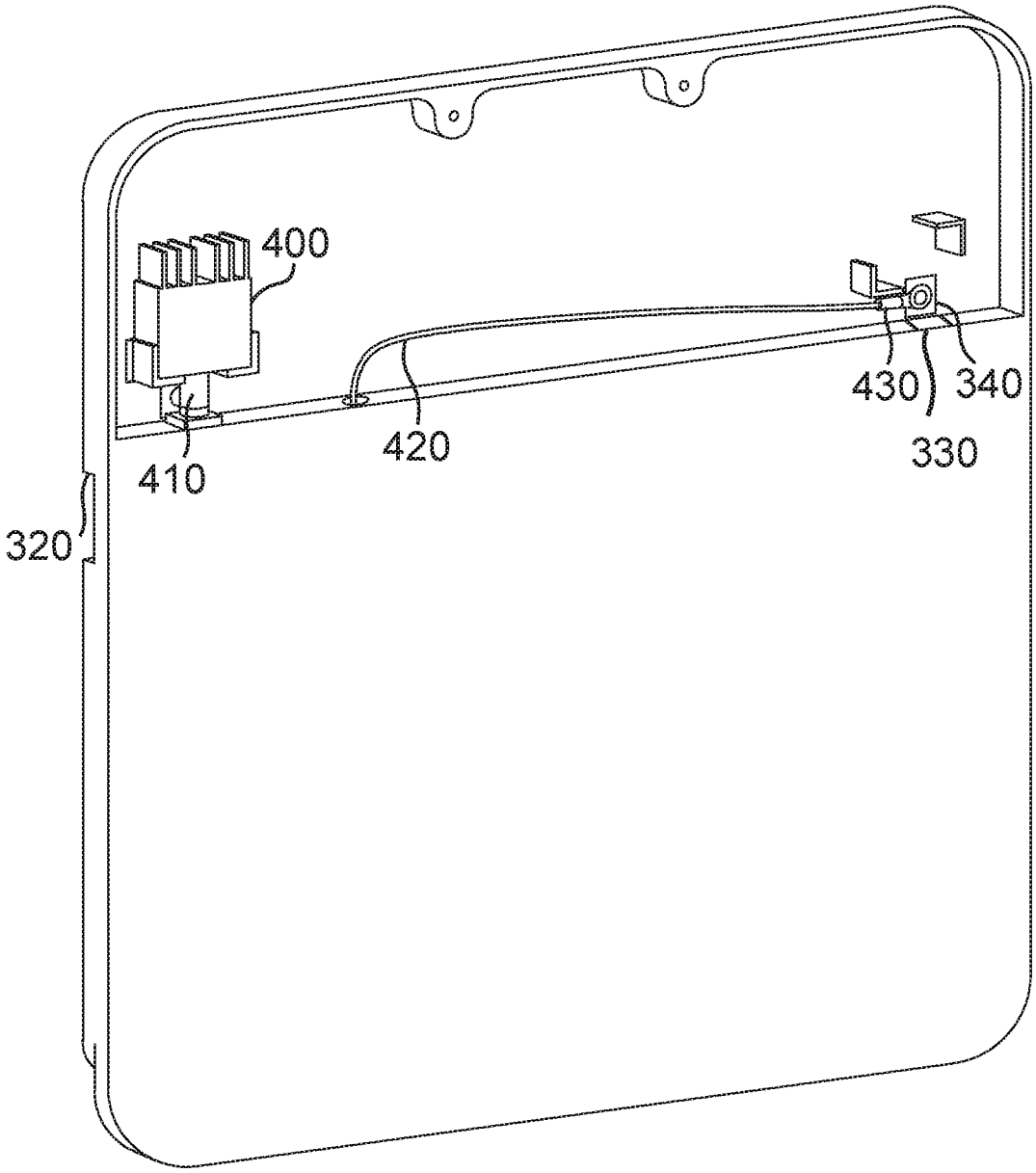
FIG. 4 depicts a close-up interior view of one embodiment of the at least one opening of each suspendable object.

FIG. 4 depicts a close-up interior view of one embodiment of the at least one opening 330 of each suspendable object 300. Each opening 330 comprises a second electrical conductor 340. In one embodiment, the second electrical conductor 340 is located near the outside interior wall of each opening 330. In one embodiment, the second electrical conductor 340 comprises a metal blade. In other embodiments, the second electrical conductor 340 is another of a variety of electrical conductors commonly known in the art. The second electrical conductor 340 engages the first electrical conductor 150 of the lip 140 of the connector 100 when the opening 330 engages the lip 140. The opening 330 engages the lip 140 when the lip 140 slides into the opening 330 and latches on. In one embodiment, each opening 330 is dimensioned such that the lip 140 of each connector 100 fits securely inside the opening 330. In one embodiment, each opening 330 measures between approximately 0.01 and 0.5 inches in depth, preferably measuring approximately 0.2 inches in depth. In one embodiment, each opening 330 is small enough that it does not admit a human finger. This is necessary so that the electrical connection is completely insulated from human interaction and completely safe. In one embodiment, each horizontal track 320 comprises two openings 330. Particularly in embodiments in which one suspendable object 300 comprises more than one opening 330, each opening is equipped with a safety device 400. In one embodiment, the safety device 400 comprises at least one button 410 that must be pushed to complete an electrical circuit. In this way, in a situation where one opening 330 is engaged with a connector 100, providing an electrical power supply to the suspendable object 300, but other free-standing additional openings 330 are present, any free-standing additional opening 330 is secured against causing electrical shock in that the at least one button 410 of the safety device 400 located in each free-standing opening 330 would have to be pushed in order to allow the electrical power supply to connect with the second electrical conductor 340 in each free-standing opening 330. In one embodiment, the second electrical conductor 340 in each opening 330 is connected to wiring 420 within the suspendable object 300 that is necessary to power the suspendable object 300 (or any appendages), which wiring 420 may be located within the walls of the suspendable object 300. In one embodiment, the wiring 420 is connected to the second electrical conductor 340 by means of a juncture piece 430.

Figure 5A:
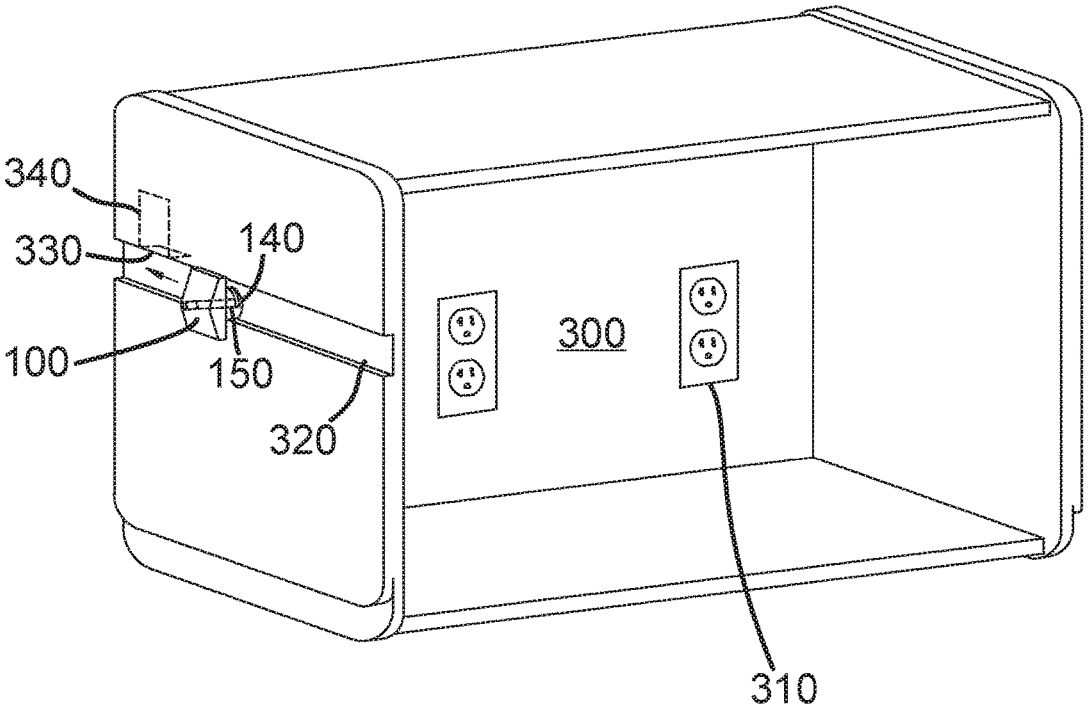
FIG. 5A depicts one embodiment of a connector sliding along the horizontal track.
Figure 5B:
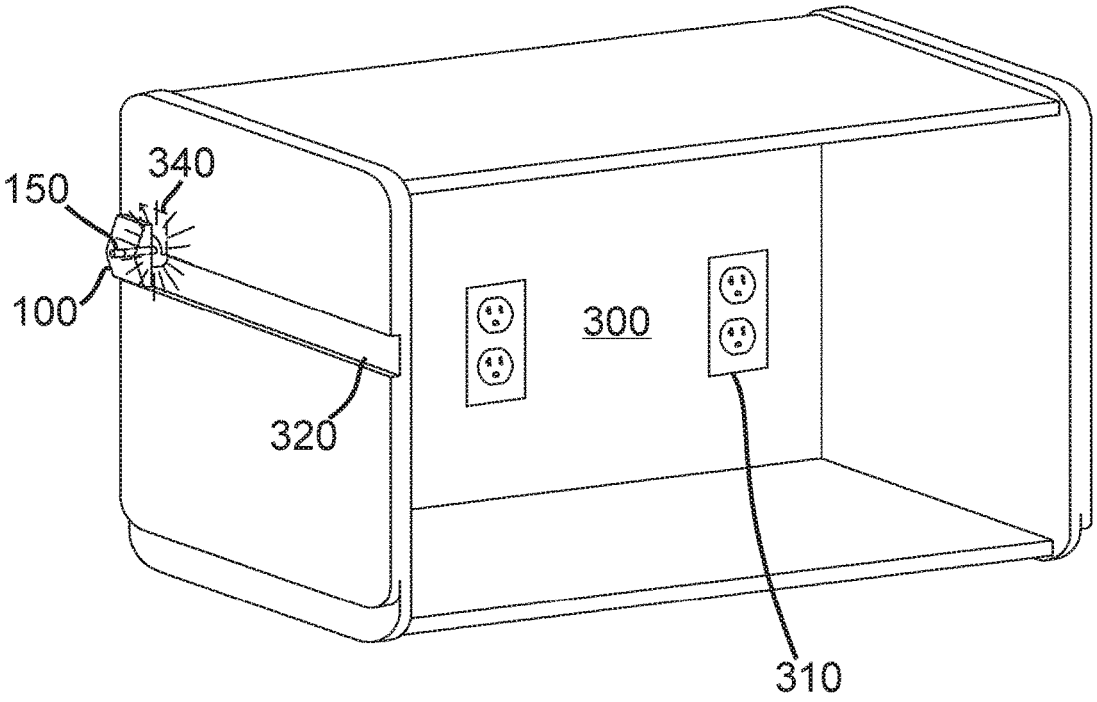
FIG. 5B depicts one embodiment of an opening engaging the lip of a connector, and the first electrical conductor and the second electrical conductor engaging when the opening engages the lip.

FIG. 5A and FIG. 5B depict embodiments of one suspendable object 300 comprising at least one horizontal track 320 comprising at least one opening 330, and the at least one opening 330 engaging the lip 140 of a connector 100, when the connector 100 slides along the horizontal track 320, and the at least one opening 330 comprising a second electrical conductor 340 that engages the first electrical conductor 150 of lip 140 of the connector 100 when the at least one opening 330 engages the lip 140. Specifically, FIG. 5A depicts a connector 100 sliding along the horizontal track 320. A horizontal track is a guide piece. In one embodiment, each horizontal track 320 comprises an indentation in the suspendable object 300. In one embodiment, each horizontal track 320 spans a width of the suspendable object 300. In one embodiment, each horizontal track 320 is approximately 0.6 inches tall and 0.375 inches deep. In one embodiment, at least one opening 330 is located at the top of each horizontal track 320. In one embodiment, each horizontal track 320 comprises two openings 330. The one or more connectors 100 are small enough to fit inside each horizontal track 320. Each connector 100 slides along the horizontal track 320 until the lip 140 of the connector 100 catches on, or engages, the opening 330 in the horizontal track 320. Sliding along the horizontal track 320 allows the connector 100 to be guided toward the opening 330 of the suspendable object 300, so that it can quickly and easily latch on to the opening 330, even when the opening 330 of the suspendable object 300 is not at first precisely lined up to connect with the connector 100. When the lip 140 of the connector 100 engages the opening 330, or, in other words, is inserted into the opening 330 and latched on, the suspendable object 300 is suspended from the wall. Furthermore, a second electrical conductor 340 inside the opening 330 engages a first electrical conductor 150 in the lip 140 of the connector 100, thereby creating an electrical connection that supplies power from the connector 100, which is coupled to a source of electrical power 160, to the suspendable object 300. FIG. 5B depicts an opening 330 engaging the lip 140 of a connector 100, and the first electrical conductor 150 and the second electrical conductor 340 engaging when the opening 330 engages the lip 140. In one embodiment, the first electrical conductor 150 is a metal rod. In one embodiment, the second electrical conductor 340 is a metal blade. The second electrical conductor 340 is located near the outside interior wall of each opening 330. When the lip 140 of the connector 100 is inserted into the opening 330, the first electrical conductor 150 on the lip 140, and preferably also extending to cover the bottom of the groove 130 of the connector 100, touches the second electrical conductor 340 on the outside interior wall of the opening 330. The first electrical conductor 150 is coupled to a source of electrical power 160, so electrical power is passed from the first electrical conductor 150 through to the second electrical conductor 340 and to the suspendable object 300, thereby supplying power to the suspendable object 300.

Figure 6A:
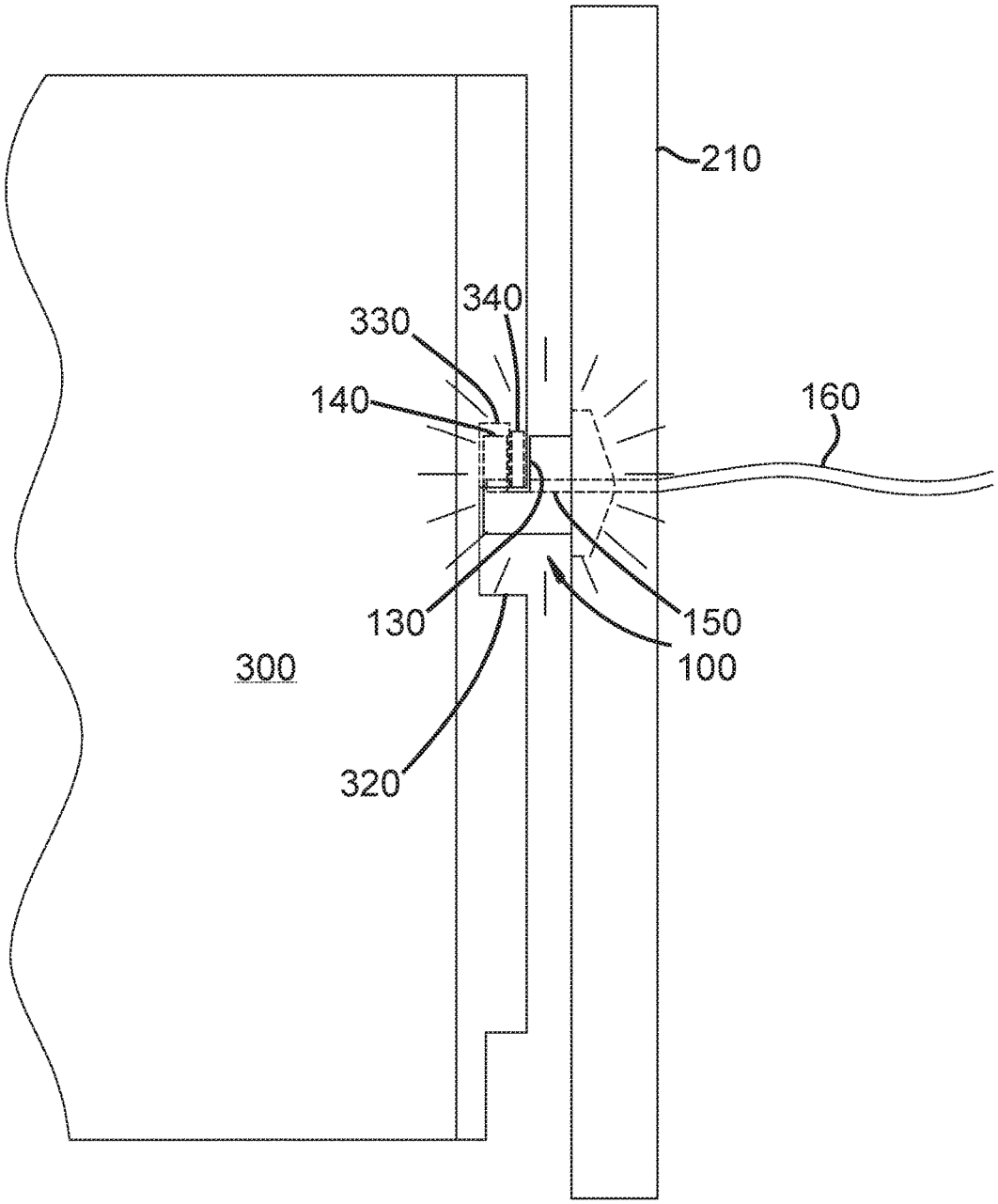
FIG. 6A depicts one embodiment of a suspendable object with one horizontal track being suspended from a wall when an opening of the horizontal track engages the lip of a connector.
Figure 6B:
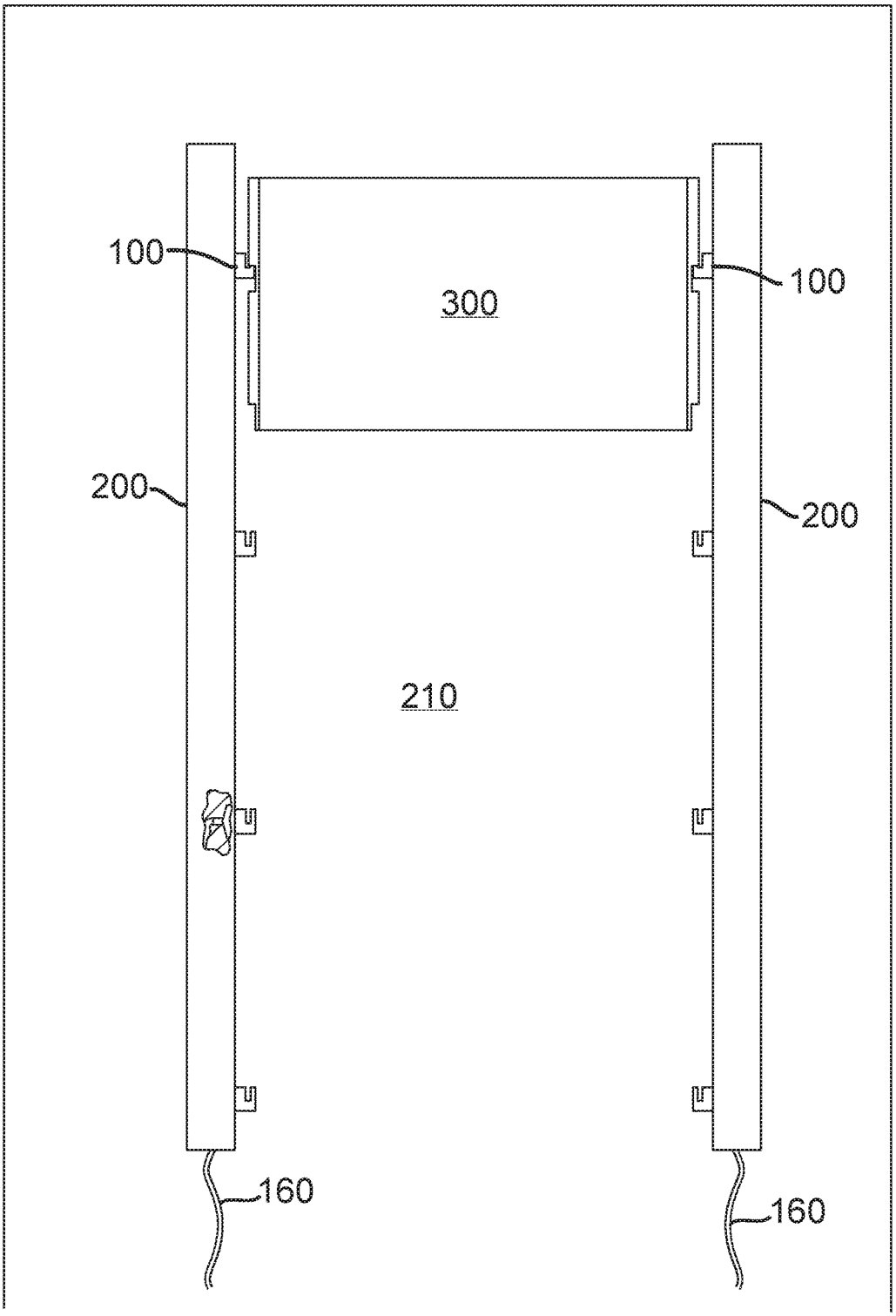
FIG. 6B depicts one embodiment of a suspendable object with two horizontal tracks being suspended from a wall when at least one opening of each horizontal track engages the lip of a connector.

FIG. 6A and FIG. 6B depict embodiments of a suspendable object 300 being suspended from a wall 210 when the at least one opening 330 of the suspendable object 300 engages the lip 140 of one or more connectors 100. Each suspendable object 300 in the invented system comprises at least one horizontal track 320 comprising at least one opening 330 that engages the lip 140 of the one or more connectors 100 when the one or more connectors 100 slide along the at least one horizontal track 320. The one or more connectors 100 are small enough to fit inside each horizontal track 320. Each connector 100 slides along the horizontal track 320 until the lip 140 of the connector 100 catches on, or engages, the opening 330 in the horizontal track 320. Sliding along the horizontal track 320 allows the connector 100 to be guided toward the opening 330 of the suspendable object 300, so that it can quickly and easily latch on to the opening 330, even when the opening 330 of the suspendable object 300 is not at first precisely lined up to connect with the connector 100. When the lip 140 of the connector 100 engages the opening 330, or, in other words, is inserted into the opening 330 and latched on, the suspendable object 300 is suspended from the wall 210 to which the connector 100 is mounted. Furthermore, a second electrical conductor 340 inside the opening 330 engages a first electrical conductor 150 in the lip 140 of the connector 100, thereby creating an electrical connection that supplies power from the connector 100, which is coupled to a source of electrical power 160, to the suspendable object 300. In one embodiment, each connector 100 can hold up to 20 pounds of weight.

Each suspendable object 300 comprises at least one horizontal track 320. In one embodiment, each suspendable object 300 comprises two horizontal tracks 320. In one embodiment, each suspendable object 300 comprises two horizontal tracks 320 that are located in identical positions on two opposite sides of each suspendable object 300. Each horizontal track 320 comprises at least one opening 330. In one embodiment, each horizontal track 320 comprises two openings 330. FIG. 6A depicts an embodiment of a suspendable object 300 with one horizontal track 320 being suspended from a wall 210 when an opening 330 of the horizontal track 320 engages the lip 140 of a connector 100. In this embodiment, the horizontal track 320 has just one opening 330. In some embodiments, a suspendable object 300 with one horizontal track 320 may have two or more openings 330 in the horizontal track 320, which may engage with two or more connectors 100 mounted to a wall 210 simulataneously. In some embodiments, the connectors 100 may also be attached to one or more rails 200 that are mounted to the wall 210. FIG. 6B depicts an embodiment of a suspendable object 300 with two horizontal tracks 320 being suspended from a wall 210 when at least one opening 330 of each horizontal track 320 engages the lip 140 of a connector 100. In this embodiment, the two horizontal tracks 320 are located in identical positions on opposites sides of the suspendable object 300. In another embodiment, two horizontal tracks 320 of one suspendable object 300 are stacked on top of one another on just one side of the suspendable object 300. In one embodiment, the openings 330 of the two horizontal tracks 320 engage with two or more connectors 100 mounted to the wall 210 simultaneously. In one embodiment, each connector 100 is mounted directly to the wall 210. In another embodiment, one or more rails 200 are mounted to the wall 210, and the one or more connectors 100 are attached to the one or more rails 200. In one embodiment, the one or more connectors 100 are attached to the one or more rails 200 in a position such that the one or more connectors 100 are parallel to the wall 210. In another embodiment, the one or more connectors 100 are attached to the one or more rails 200 in a position such that the one or more connectors 100 are perpendicular to the wall 210. In one embodiment, each rail 200 or each connector 100 is wired with both live and neutral wires. In another embodiment, there are two rails 200, and one is wired with a live wire and one is wired with a neutral wire. The one or more connectors 100 attached to the two rails 200 thus have respective live and neutral wiring. When a suspendable object 300 is suspended simultaneously from one live connector 100 and one neutral connector 100, a complete circuit is formed, supplying power to the suspendable object. In one embodiment, the wires within the rails 200 are coupled directly to wires located within the wall 210 that are part of an electrical circuit. In another embodiment, the wires within the rails 200 are joined at the position where they protrude from the rails 200 into a common electrical plug that can be plugged into an electrical outlet.

Figure 7:
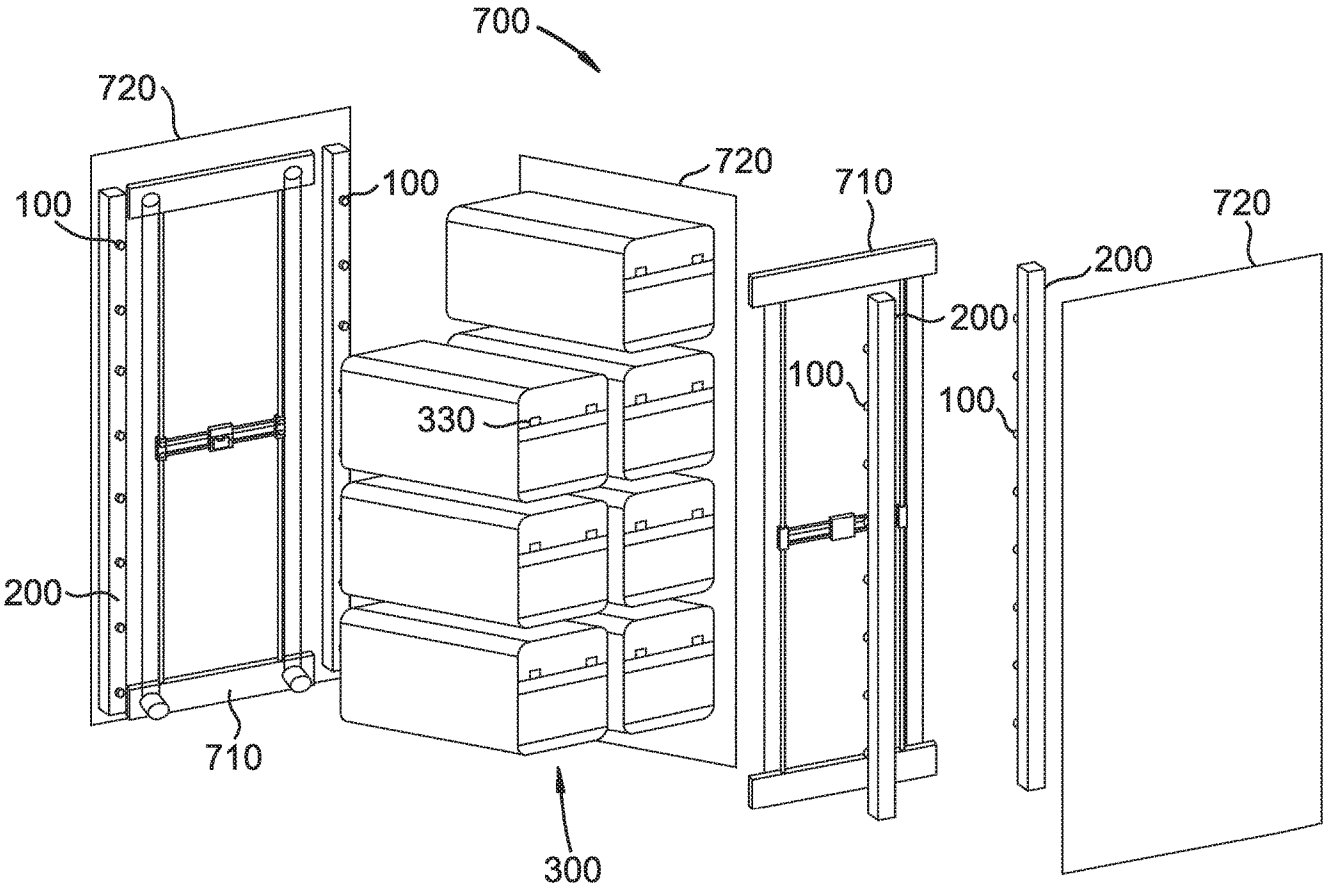
FIG. 7 depicts one embodiment of the invented system, wherein the one or more connectors and the one or more suspendable objects are components in an automated storage and retrieval system.

FIG. 7 depicts one embodiment of the invented system, wherein the one or more connectors 100 and the one or more suspendable objects 300 are components in an automated storage and retrieval system 700. In different embodiments, the automated storage and retrieval system 700 is that which is described in Automatic Storage and Retrieval System with Planar Motion Mechanism, patent specification No. U.S. Ser. No. 15/248,589; Automated Storage and Retrieval Direct Movement Method, patent specification No. U.S. Ser. No. 15/260,979; or Automated Storage and Retrieval System with Retractable Mountings, patent specification No. U.S. Ser. No. 15/278,545, which are commonly owned by the Applicant and incorporated by reference for all that they teach.

In one embodiment, the automated storage and retrieval system 700 comprises one or more planar motion mechanisms 710 moveably mounted to a frame 720 that suspend the one or more suspendable objects 300 from the one or more connectors 100 to reposition the one or more suspendable objects 300 within the frame 720. In one embodiment, the one or more planar motion mechanisms 710 are H-bots. The one or more connectors 100 are mounted to walls of the frame 720, or to one or more rails 200 that are mounted to the walls of the frame 720. The one or more suspendable objects 300 may be arranged in one, two, or more columns within the frame 720, and each suspendable object 300 is suspended from a wall of the frame 720 by means of one or more of the connectors 100. The one or more planar motion mechanisms 710 lift and suspend the one or more suspendable objects 300 from the one or more connectors 100 to reposition the one or more suspendable objects 300 within the frame 720. When the one or more suspendable objects 300 are stationary, suspended from the connectors 100 on the walls of the frame 720 by means of the at least one opening 330 in each suspendable object 300 engaging with a lip 140 of the one or more connectors 100, the first electrical conductor 150 of each connector 100 engages with the second electrical conductor 340 in the at least one opening 330 of each suspendable object 300, thereby creating a supply of electrical power from the connector 100 to the suspendable object 300. In this way, each suspendable object 300 can be connected to electrical power during storage, without regard to where each suspendable object 300 is moved by the one or more planar motion mechanisms 710. This is particularly beneficial when storing electrical appliances, which may be done in order to conserve the space that the appliances would otherwise occupy. For example, if a bread machine were inserted into the automated storage and retrieval system 700 that utilized the invented system, a user could add ingredients to the bread machine, start a bread making cycle, and put the bread machine into the storage system. As the bread machine was stored, it would have a nearly continuous supply of electrical power that would enable the bread machine to complete the bread making cycle even while being stored and moved around within the automated storage and retrieval system 700. The same would be true of a refrigerator or an oven. The same would not be true if these appliances were powered by means of power cords. Therefore, this is one preferred application of the present invention, but many other applications also exist.

The invention claimed is:

1. A system comprising:

one or more connectors mounted to a wall, each connector comprising a groove comprising a first electrical conductor coupled to a source of electrical power; and one or more suspendable objects, each suspendable object comprising at least one horizontal track comprising at least one opening that engages the groove when the one or more connectors slide along the at least one horizontal track, thereby suspending the one or more suspendable objects from the wall, and the at least one opening comprising a second electrical conductor that engages the first electrical conductor when the at least one opening engages the groove.

2. The system of claim 1, wherein the one or more connectors comprise cylindrical pins.

3. The system of claim 2, wherein the one or more connectors have a diameter of between approximately 0.5 inches and 1 inch.

4. The system of claim 1, wherein the groove of each connector comprises a right-angled slot spanning a width of the connector and approximately one half of a height of the connector.

5. The system of claim 1, wherein the groove of each connector measures between approximately 0.1 and 0.2 inches in depth.

6. The system of claim 1, wherein the first electrical conductor in each connector comprises a metal rod.

7. The system of claim 1, wherein the groove of each connector comprises a lip that measures between approximately 0.05 inches and 1 inch in depth.

8. The system of claim 7, wherein the at least one opening of each suspendable object is dimensioned such that the lip fits securely inside.

9. The system of claim 1, wherein the at least one opening of each suspendable object does not admit a human finger.

10. The system of claim 1, wherein the at least one horizontal track comprises an indentation in the suspendable object.

11. The system of claim 1, wherein the second electrical conductor in each opening comprises a metal blade.

12. The system of claim 1, further comprising a safety device.

13. The system of claim 1, wherein each suspendable object comprises two horizontal tracks.

14. The system of claim 1, wherein each horizontal track comprises two openings.

15. The system of claim 1, further comprising one or more rails mounted to the wall, and the one or more connectors attached to the one or more rails.

16. The system of claim 15, comprising two rails, one wired with a live wire and one wired with a neutral wire.

17. The system of claim 1, wherein the one or more suspendable objects are electrical appliances selected from the group consisting of microwaves, refrigerators, ice machines, heaters, toasters, mixers, ovens, juicers, dryers, grinders, dispensers, freezers, gas and electric cook tops, gas and electric ranges, bread machines, humidifiers, and grills.

18. The system of claim 1, wherein the one or more suspendable objects comprise storage bins.

19. The system of claim 1, wherein the one or more connectors and the one or more suspendable objects are components in an automated storage and retrieval system.

20. The system of claim 19, wherein the automated storage and retrieval system comprises one or more planar motion mechanisms moveably mounted to a frame that suspend the one or more suspendable objects from the one or more connectors to reposition the one or more suspendable objects within the frame.

* * * * *